United States Patent [19]

Soileau

[11] 4,358,816

[45] Nov. 9, 1982

[54] ROADWAY LUMINAIRE

[75] Inventor: Trasimond A. Soileau, Flat Rock, N.C.

[73] Assignee: General Electric Company, Schenectady, N.Y.

[21] Appl. No.: 184,649

[22] Filed: Sep. 5, 1980

[51] Int. Cl.[3] ..... F21V 7/00

[52] U.S. Cl. ..... 362/346; 362/145; 362/347; 362/348

[58] Field of Search ..... 362/145, 341, 346, 347, 362/348, 361

[56] References Cited

U.S. PATENT DOCUMENTS

| | | | |
|---|---|---|---|
| 3,700,883 | 10/1972 | Donohue | 362/347 |
| 3,740,545 | 6/1973 | Franklin | 362/347 |
| 4,028,542 | 6/1977 | McReynolds | 362/347 |
| 4,081,667 | 3/1978 | Lewin | 362/296 |
| 4,237,528 | 12/1980 | Baldwin | 362/347 |
| 4,242,727 | 12/1980 | deVos | 362/347 |

*Primary Examiner*—Donald P. Walsh

*Attorney, Agent, or Firm*—Ernest W. Legree; Philip L. Schlamp; Fred Jacob

[57] ABSTRACT

Luminaire provides relatively uniform illumination in substantially rectangular pattern up and down the roadway adjacent the luminaire. The luminaire reflector is formed with a multiplicity of flat facets individually oriented to direct light to particular areas along the roadway surface.

9 Claims, 4 Drawing Figures

ROADWAY LUMINAIRE

The present invention relates to luminaires, and more particularly concerns luminaires for illuminating roadways and streets.

It is an object of the invention to provide a luminaire of the above type adapted to be mounted at the side of a roadway which illuminates the roadway relatively uniformly along the length thereof adjacent the luminaire.

It is a particular object of the invention to provide a luminaire of the above type having a reflector for distributing the light as intended without the need for a refractor for controlling the distribution of light rays.

Another object of the invention is to provide a reflector for a luminaire of the described type which is formed of reflecting facets for producing a relatively uniformly lighted, generally rectangular pattern along the length of the roadway surface.

Other objects and advantages will become apparent from the following description and the appended claims.

With the above objects in view, the present invention in one of its aspects relates to a luminaire adapted to be mounted at the side of a roadway for relatively uniformly illuminating the remote, intermediate and near portions of the roadway surface comprising, in combination, a generally ovate concave reflector having curved side walls extending between the street side and the house side of the reflector and a rim defining a bottom opening, the reflector having a light center therein, a light source arranged at the light center, at least one side wall of the reflector being formed of a plurality of reflecting facets, the facets being arranged in a plurality of horizontally adjacent panels, each panel comprising a plurality of vertically adjacent facets, the facets arranged in substantially horizontally extending lower, intermediate and upper rows, the facets in the lower, intermediate upper rows directing light rays respectively to the remote, intermediate and near portions of the roadway, the facets in the panels nearer the house side of the reflector directing light rays toward the opposite side of the roadway, and the facets in the panels nearer the street side of the reflector directing light rays toward the luminaire side of the roadway, whereby the roadway is relatively uniformly illuminated in both longitudinal and lateral directions.

In a preferred embodiment of the invention, the top of the reflector rearward of the light center (i.e., on the house side thereof) is formed with a plurality of substantially parallel, downwardly convex ridges for reflecting light rays directly across the roadway.

The invention will be better understood from the following description taken in conjunction with the accompanying drawings, in which.

Figure 1:
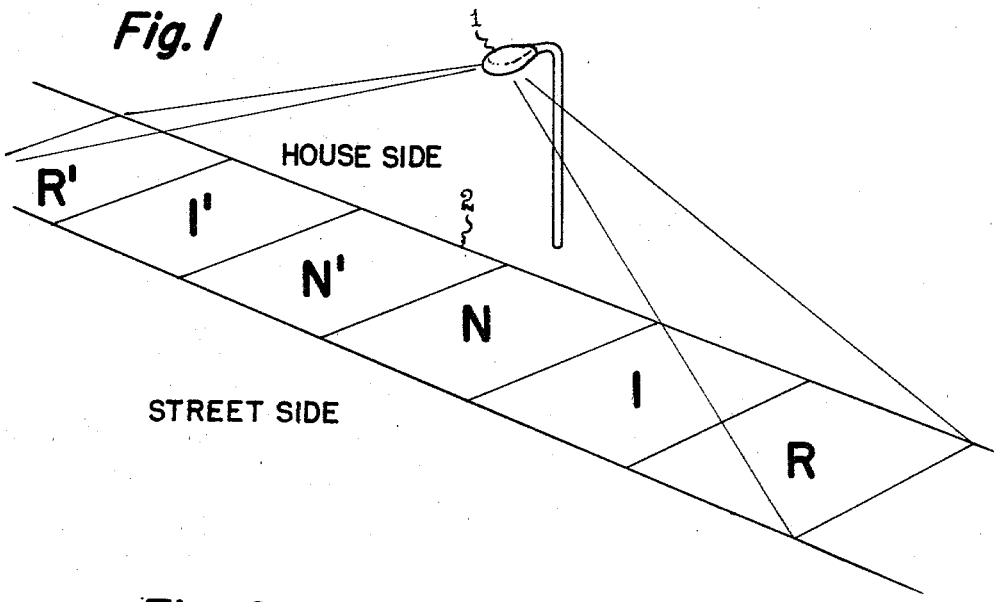
FIG. 1 is a diagrammatic view of a luminaire in which the invention may be embodied mounted adjacent a roadway for illuminating the latter in accordance with the principles of the invention.

Referring now to the drawings, and particularly to FIG. 1, there is diagrammatically illustrated a luminaire 1 mounted at the side of a street or roadway 2 for illuminating the roadway surface along the length thereof on oposite sides of the luminaire. For purposes of the explanation set forth hereinafter concerning the illuminating function of various parts of the luminaire reflector, the roadway surface is shown in FIG. 1 as comprising area R remote from the luminaire, area N near the luminaire, and area I intermediate the other two areas, with the roadway on the other side of the luminaire being similarly divided into areas R′, I′, and N′. It should be understood that the relative dimensions of these areas in the longitudinal direction of the roadway as shown do not necessarily correspond to actual conditions. Thus, typically, the length of intermediate area I will be substantially greater than that of areas R and N. In a usual installation, remote area R will also be illuminated by the next luminaire down the street (not shown).

Figure 2:
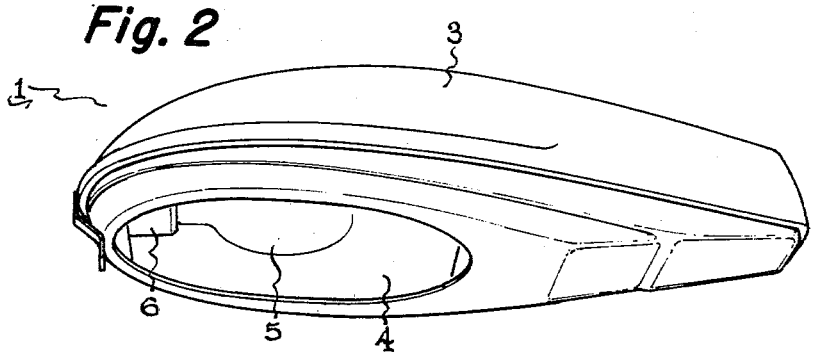
FIG. 2 is a perspective view of a luminaire incorporating a reflector embodying the invention.
Figure 3:
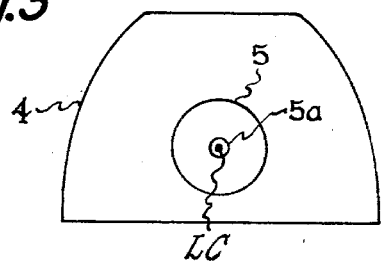
FIG. 3 is a diagrammatic view of transverse vertical section of the reflector of the FIG. 2 luminaire.

A street lighting luminaire embodying the invention is shown in FIG. 2 and comprises a housing 3 in which is located reflector 4 and elongated lamp 5, which is typically a high intensity gaseous discharge lamp such as a sodium vapor or mercury vapor lamp. Lamp 5 in the illustrated embodiment is removably mounted within reflector 4 by socket 6 which extends through the front end (street side) of the reflector, so that the elongated lamp projects toward the rear of the reflector along the longitudinal axis of the ovate reflector. The arrangement is preferably such that, as seen in FIG. 3, the arc tube 5*a* of lamp 5 lies at the light center LC of the reflector. It will be understood, however, that the lamp may be mounted with its base at the rear (house side) of the reflector and project forwardly, instead of as shown.

Reflector 4 is mounted within luminaire housing 3 with its rim substantially horizontal and its mouth downwardly facing, with no refractor or closure lens usually being provided. As a result, the sharp cut-off of the light emanating from the luminaire due to the precise light control afforded by the facets as described hereinafter is not diminished, and the undesirable glare or brightness which might otherwise be caused at high vertical angles in use of known types of refractors is avoided. Where necessary or desirable, however, a flat glass or plastic lens may be employed as a closure for the reflector opening.

Figure 4:
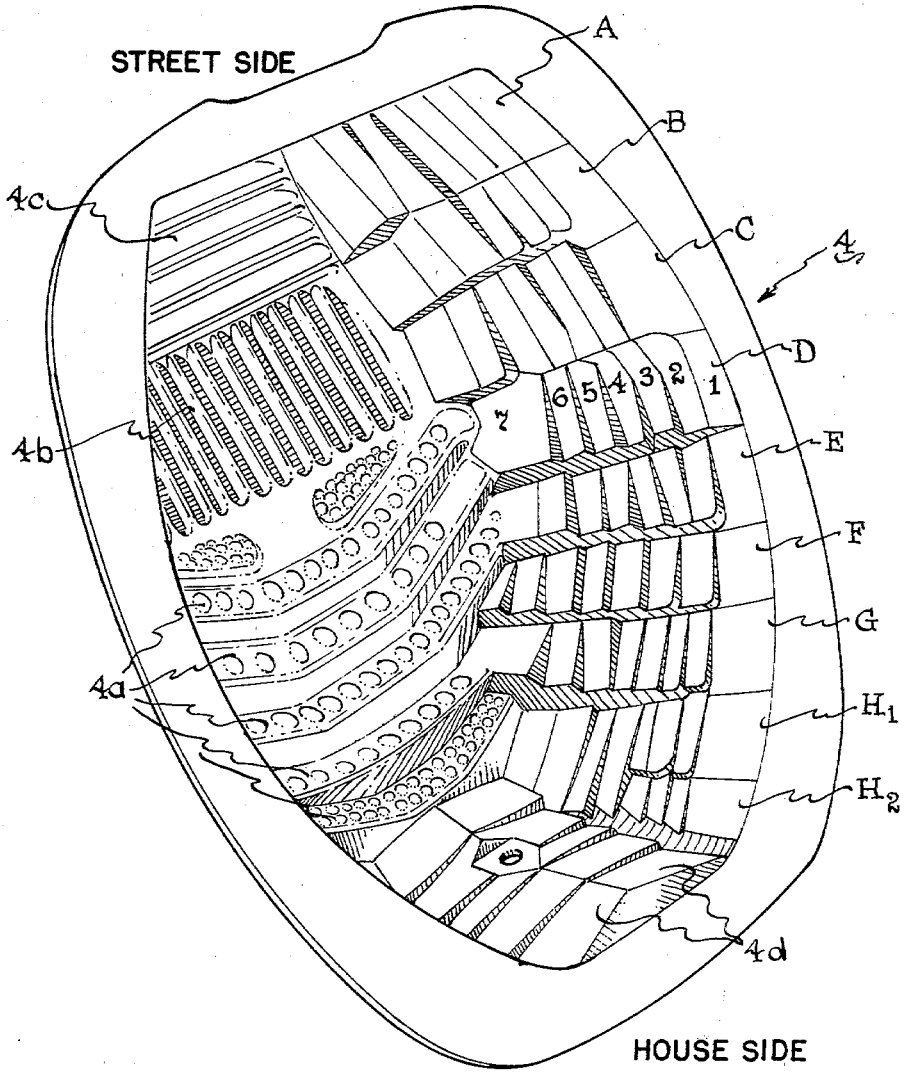
FIG. 4 is a view into the interior of a reflector formed with reflecting facets in accordance with an embodiment of the invention.

In accordance with the invention, reflector 4, as shown in detail in FIG. 4, is formed on its opposite side walls with a plurality of faceted panels arranged and formed to direct the light in a rectangular pattern up and down the roadway with substantially uniform light distribution on the remote, intermediate and near areas described above. Since the reflector is normally symmetrically formed, the description herein relative to one side wall thereof will apply to the opposite side wall as well. In general, the ovate reflector is approximately elliptical in horizontal section and its side walls are approximately parabolic in vertical section, the curvature, however, being modified by the particular orientation of the various facets and panels as described below. As seen in FIG. 4, the reflector side wall divided into a plurality of horizontally adjacent panels A–$H_2$, each panel comprising a plurality of vertically adjacent flat facets, such as those designated facets 1–7 in panel D. The facet may also be considered as arranged generally in horizontally extending rows, with lowermost rows containing facets 1–4 of each panel, intermediate rows comprising facets 5,6 of each panel, and the uppermost row or rows comprising the upper facets such as facet 7 of each panel. The arrangement is such that the lower facet rows direct the light rays to remote roadway area R, the intermediate facet rows direct the light to intermediate area I, and the uppermost facet row or rows direct the light to the near area N, i.e., close to the luminaire. In general, due largely to the side wall curvature, the facets in the panels nearer the house side, viz., panels F, G and $H_1$, $H_2$ direct the light toward the street side curb of all the roadway areas, whereas the facets in the panels nearer the street side direct the light toward the house side curb of the roadway. However, in accordance with a feature of the invention, the facets in the intermediate rows in a plurality of panels in the intermediate rows in a plurality of panels located in the reflector portion from about midway of the side wall toward the house side are angled away from the normal curvature of the side wall toward the street side of the reflector, in order to more uniformly illuminate the portion of the intermediate roadway area I adjacent the street side curb. Thus, facets 5, 6, and 7 of panels D,E,F and G are so oriented that the angles they form relative to the vertical median transverse plane of reflector 4 are substantially less than the angles formed by the lower facets 1–4 of the same respective panels. Typically, the angles made by facets 5,6, and 7 in the panels referred to relative to the vertical median transverse plane are about 10° less than the angles made by the lower facets in the same panel. Thus, by way of example, while facets 1–4 in central panel D form angles of about 90° relative to the transverse median plane, facets 5–7 in the same panel form angles of about 80° relative to that plane.

In a faceted reflector of the described type which has provided satisfactory results in accordance with the invention the panels listed below had facets arranged at angles relative to the vertical transverse median plane approximately as follows:

| | Facet No. | Angle |
|---|---|---|
| Panel D | 1–4 | 90° |
| | 5 | 82° |
| | 6 | 80° |
| | 7 | 78° |
| Panel E | 1 | 77° |
| | 2–4 | 74° |
| | 5 | 69° |
| | 6 | 66° |
| | 7 | 62° |
| | 8 | 57° |
| Panel F | 1 | 65° |
| | 2 | 64° |
| | 3 | 61° |
| | 4 | 59° |
| | 5 | 57° |
| | 6 | 55° |
| | 7 | 52° |
| Panel G | 1 | 59° |
| | 2 | 58° |
| | 3 | 55° |
| | 4 | 53° |
| | 5 | 52° |
| | 6 | 54° |
| | 7 | 41° |
| | 8 | 35° |

The inner top surface of reflector 4 is formed, in the portion rearward of the vertical median transverse plane, with a series of parallel convex ridges **4*a* extending in an arc-shaped pattern and serving to reflect light from the lamp in a direction across the street from the luminaire, so as to provide illumination of the roadway surface in front of the luminaire. The arc shape of ridges 4*a*** serves to converge the reflected rays so as to avoid further reflection thereof by the forward portion of the reflector prior to passing out of the reflector. The ridges may be provided with dimples as shown for somewhat diffusing the reflected light beams.

Parallel reflecting ribs **4*b*** arranged forward of and extending normal to the transverse median plane serve to direct light incident thereon downwardly below the luminaire while spreading the reflected beams somewhat.

Stepped parallel ribs **4*c* at the street end of reflector 4 extending normal to ribs 4*b*** serve to direct whatever light is incident thereon from the lamp directly below the luminaire to illuminate the house side portion of the roadway in that area.

The house side end of reflector 4 is formed with a roof-shaped faceted surface **4*d* which receives the rather small amount of light emanating from the end of lamp 5** and reflects the same in diverging paths downwardly toward the near areas N, N′ adjacent the street side curb.

By virtue of the described reflector structure, a relatively uniformly illuminated rectangular pattern is provided along the roadway with a minimum of glare produced in the eyes of an oncoming motorist. The use of a plurality of reflecting facets in accordance with the invention makes it possible to more precisely control the light pattern on the roadway, as compared to non-faceted reflectors, and, furthermore, by providing limited overlapping of light rays in the light distribution on the roadway, the described faceted construction minimizes problems which might otherwise occur due to distortion of the reflector surface in the process of manufacture and handling.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

I claim:

1. A luminaire adapted to be mounted at the side of a roadway for relatively uniformly illuminating the remote, intermediate and near portions of the roadway surface comprising, in combination, a generally ovate concave reflector having curved side walls extending between the street side and the house side of the reflector and a rim defining a bottom opening, said reflector having a light center therein, a light source arranged at said light center, at least one side wall of said reflector being formed of a plurality of reflecting facets, said facets being arranged in a plurality of horizontally adjacent panels, each panel comprising a plurality of vertically adjacent facets, said facets arranged in substantially horizontally extending lower, intermediate and upper rows, the facets in said lower, intermediate and upper rows directing light rays respectively to the remote, intermediate and near portions of the roadway, the facets in the panels nearer the house side of the reflector directing light rays toward the opposite side of the roadway, and the facets in the panels nearer the street side of the reflector directing light rays toward the luminaire side of the roadway, the facets in intermediate rows of a plurality of panels on the house side of the vertical median transverse plane of said reflector extending at angles to said plane less than the angles formed by facets in the lower rows of the same respective panels, whereby the roadway is relatively uniformly illuminated in both longitudinal and lateral directions.

2. A luminaire as defined in claim 1, said bottom opening of the reflector being free of any closure.

3. A luminaire as defined in claim 1, said reflector being generally elliptical in horizontal section and said side walls being generally parabolic in vertical section.

4. A luminaire as defined in claim 1, wherein said first-mentioned angles are about 10° less than said second-mentioned angles.

5. A luminaire as defined in claim 1, said reflector having a top surface formed on the house side of the vertical median transverse plane of the reflector with a plurality of substantially parallel reflecting ridges for directing light from said lamp across the roadway from the luminaire.

6. A luminaire as defined in claim 5, said reflecting ridges being substantially arc-shaped for converging the light beams reflected therefrom.

7. A luminaire as defined in claim 1, said reflector being substantially symmetrical about a vertical median longitudinal plane and the side wall thereof opposite said one side wall having a structure similar to that of the latter side wall.

8. A luminaire as defined in claim 1, said reflector side walls each formed with at least five horizontally adjacent panels, each panel comprising at least five vertically adjacent substantially rectangular facets.

9. A luminaire as defined in claim 8, wherein substantially the entire surface of said reflector side walls is formed of said facets.

* * * * *